US010508499B2

(12) United States Patent
Hird et al.

(10) Patent No.: US 10,508,499 B2
(45) Date of Patent: Dec. 17, 2019

(54) REAMER

(71) Applicant: SCHLUMBERGER TECHNOLOGY CORPORATION, Sugar Land, TX (US)

(72) Inventors: Jonathan Robert Hird, Cambridge (GB); Ashley Bernard Johnson, Cambridge (GB); Gokturk Tunc, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 83 days.

(21) Appl. No.: 15/328,058

(22) PCT Filed: Jul. 21, 2015

(86) PCT No.: PCT/US2015/041223
§ 371 (c)(1),
(2) Date: Jan. 22, 2017

(87) PCT Pub. No.: WO2016/014448
PCT Pub. Date: Jan. 28, 2016

(65) Prior Publication Data

US 2017/0204670 A1 Jul. 20, 2017

(30) Foreign Application Priority Data

Jul. 21, 2014 (GB) ..... 1412931.6

(51) Int. Cl.
*E21B 7/28* (2006.01)
*E21B 10/32* (2006.01)
*E21B 10/56* (2006.01)

(52) U.S. Cl.
CPC ..... *E21B 10/32* (2013.01); *E21B 7/28* (2013.01); *E21B 10/322* (2013.01); *E21B 10/56* (2013.01)

(58) Field of Classification Search
CPC ..... E21B 7/28; E21B 10/32; E21B 10/322; E21B 10/43; E21B 10/46; E21B 10/56
See application file for complete search history.

(56) References Cited

U.S. PATENT DOCUMENTS 4,431,065 A * 2/1984 Andrews ..... E21B 10/567 175/269
4,499,959 A * 2/1985 Grappendorf ..... E21B 47/18 175/405.1

(Continued)

FOREIGN PATENT DOCUMENTS

CA 2397110 A1 * 2/2003 ..... E21B 10/32
CN 102086756 A 6/2011

(Continued)

OTHER PUBLICATIONS

International Search Report and Written Opinion for related Application Serial No. PCT/US2014/068991, dated Mar. 25, 2015, 14 pages.

(Continued)

*Primary Examiner* — Jennifer H Gay

(57) ABSTRACT

A reaming tool for enlarging an underground borehole comprises a plurality of cutter assemblies (251, 252, 253) distributed azimuthally around a longitudinal axis of the tool, wherein each cutter assembly comprises support structure bearing a sequence of cutters (211-214) with leading surfaces facing in a direction of rotation of the tool and the sequence of cutters extends axially along the tool from an axial end (202) of the tool with the cutters positioned at radial distances from the tool axis which progressively increase as the sequence extends away from the axial end of (Continued)

the tool. The cutter assemblies include guiding structure (261-264) which is positioned circumferentially ahead of the leading faces of cutters of the sequence on the assembly. This guiding structure is configured such that the outline of the guiding structure is able to coincide with at least part of the notional surface described by the cutting outline of the preceding cutter assembly as the tool rotates, without any part of the guiding structure projecting outside that notional surface. This stabilises the positioning of the rotating tool in the borehole.

15 Claims, 8 Drawing Sheets

(56) References Cited

U.S. PATENT DOCUMENTS 4,593,777 A 6/1986 Barr
4,710,074 A 12/1987 Springer
4,887,668 A 12/1989 Lynde et al.
5,070,952 A * 12/1991 Neff ..... E21B 10/322 166/55.7
5,341,888 A 8/1994 Deschutter
5,967,247 A 10/1999 Pessier
6,732,817 B2 * 5/2004 Dewey ..... E21B 7/067
6,880,650 B2 4/2005 Hoffmaster et al.
6,920,923 B1 7/2005 Pietrobelli et al.
7,467,671 B2 12/2008 Savignat et al.
7,506,703 B2 * 3/2009 Campbell ..... E21B 10/322 175/263
7,571,782 B2 * 8/2009 Hall ..... E21B 10/43 175/425
7,726,415 B1 * 6/2010 Tipton ..... E21B 10/26 175/385
7,954,564 B2 * 6/2011 Makkar ..... E21B 10/322 175/263
7,963,348 B2 6/2011 Laird et al.
7,975,783 B2 7/2011 Fanuel et al.
8,162,081 B2 * 4/2012 Ballard ..... E21B 10/26 175/325.2
8,205,689 B2 6/2012 Radford
8,297,381 B2 10/2012 Radford et al.
8,517,124 B2 * 8/2013 Hareland ..... E21B 10/62 175/393
8,550,188 B2 10/2013 Makkar et al.
8,607,900 B1 * 12/2013 Smith ..... E21B 10/26 175/323
8,752,649 B2 6/2014 Isenhour
8,776,912 B2 * 7/2014 Makkar ..... E21B 7/28 175/263
8,905,126 B2 12/2014 Krieg et al.
9,051,793 B2 * 6/2015 Makkar ..... E21B 10/322
9,068,407 B2 6/2015 Radford et al.
9,074,434 B2 * 7/2015 Mensa-Wilmot ..... E21B 10/43
9,187,958 B2 * 11/2015 Mensa-Wilmot ..... E21B 7/28
9,273,519 B2 * 3/2016 Smith ..... E21B 10/26
9,593,538 B2 3/2017 Rasheed
9,739,094 B2 * 8/2017 Moreno, II ..... E21B 10/26
2001/0020552 A1 9/2001 Beaton et al.
2003/0029644 A1 2/2003 Hoffmaster et al.
2003/0155155 A1 * 8/2003 Dewey ..... E21B 7/067 175/57
2004/0188149 A1 9/2004 Thigpen et al.
2004/0222022 A1 11/2004 Nevlud et al.
2005/0034897 A1 2/2005 Youan
2007/0089912 A1 4/2007 Eddison et al.
2007/0163808 A1 * 7/2007 Campbell ..... E21B 10/322 175/57
2007/0205024 A1 * 9/2007 Mensa-Wilmot ..... E21B 10/43 175/408
2008/0128174 A1 * 6/2008 Radford ..... E21B 10/322 175/267
2008/0128175 A1 * 6/2008 Radford ..... E21B 10/322 175/269
2008/0149396 A1 6/2008 Fyfe
2008/0190670 A1 * 8/2008 Welch ..... E21B 10/43 175/430
2008/0314645 A1 * 12/2008 Hall et al. ..... E21B 10/43 175/374
2009/0145666 A1 * 6/2009 Radford ..... E21B 10/30 175/269
2009/0294178 A1 12/2009 Radford
2009/0321138 A1 * 12/2009 Shamburger ..... E21B 10/43 175/61
2010/0012387 A1 * 1/2010 Huynh ..... E21B 10/43 175/428
2010/0018779 A1 * 1/2010 Makkar ..... E21B 10/322 175/382
2010/0051349 A1 * 3/2010 Ballard ..... E21B 10/26 175/57
2010/0089649 A1 * 4/2010 Welch ..... E21B 10/43 175/61
2010/0263875 A1 10/2010 Williams et al.
2010/0276201 A1 * 11/2010 Makkar ..... E21B 7/28 175/57
2011/0005836 A1 1/2011 Radfprd et al.
2011/0005841 A1 1/2011 Wood et al.
2011/0120777 A1 5/2011 Lee
2011/0127087 A1 * 6/2011 Hareland ..... E21B 10/602 175/393
2011/0259650 A1 * 10/2011 Hall ..... E21B 10/43 175/430
2012/0012398 A1 1/2012 Hall et al.
2012/0152543 A1 6/2012 Davis
2012/0205151 A1 8/2012 Inoue et al.
2012/0205157 A1 8/2012 Radford et al.
2012/0255786 A1 * 10/2012 Isenhour ..... E21B 10/26 175/57
2013/0075167 A1 * 3/2013 Knull ..... E21B 10/43 175/428
2013/0087386 A1 4/2013 Radford et al.
2013/0146361 A1 * 6/2013 Makkar ..... E21B 10/322 175/57
2013/0199855 A1 8/2013 Shears
2013/0256036 A1 10/2013 Lyons
2013/0306380 A1 * 11/2013 Oesterberg ..... E21B 10/32 175/263
2013/0341100 A1 * 12/2013 Zhang ..... E21B 10/46 175/375
2014/0008128 A1 * 1/2014 Adam ..... E21B 10/32 175/57
2014/0048335 A1 * 2/2014 Mensa-Wilmot ..... E21B 7/28 175/263
2014/0048336 A1 * 2/2014 Mensa-Wilmot ..... E21B 10/32 175/266
2014/0246247 A1 * 9/2014 Smith ..... E21B 10/26 175/394
2014/0262523 A1 9/2014 Davis
2015/0068813 A1 * 3/2015 Moreno, II ..... E21B 10/26 175/263
2015/0144405 A1 * 5/2015 Salvo ..... E21B 10/322 175/263
2016/0290067 A1 * 10/2016 Tipples ..... E21B 17/1078
2016/0305190 A1 10/2016 Johnson et al.
2017/0058611 A1 * 3/2017 Lin, Jr. ..... E21B 10/43
2017/0204670 A1 * 7/2017 Hird ..... E21B 10/322
2017/0211332 A1 * 7/2017 Hird ..... E21B 10/322
2017/0211333 A1 * 7/2017 Hird ..... E21B 10/322
2017/0211334 A1 * 7/2017 Hird ..... E21B 10/322
2017/0211335 A1 * 7/2017 Hird ..... E21B 10/43
2017/0218707 A1 * 8/2017 Hird ..... E21B 10/567
2018/0094496 A1 * 4/2018 Su ..... E21B 29/002

FOREIGN PATENT DOCUMENTS

EP 0385673 A1 9/1990
EP 0397417 A1 11/1990
EP 0869256 A2 10/1998
EP 1811124 A1 7/2007

(56) References Cited

FOREIGN PATENT DOCUMENTS

| | | | | |
|---|---|---|---|---|
| EP | 2097610 | A1 | 9/2009 | |
| GB | 2339227 | A | 1/2000 | |
| GB | 2417267 | A | 2/2006 | |
| GB | 2520998 | A | 6/2015 | |
| WO | 03102354 | A1 | 12/2003 | |
| WO | 2004101943 | A2 | 11/2004 | |
| WO | 2005047644 | A1 | 5/2005 | |
| WO | 2005052301 | A2 | 6/2005 | |
| WO | 2007041811 | A1 | 4/2007 | |
| WO | 2008100194 | A2 | 8/2008 | |
| WO | 2010126938 | A2 | 11/2010 | |
| WO | 2013134629 | A1 | 9/2013 | |
| WO | 2013167954 | A2 | 11/2013 | |
| WO | WO-2013173607 | A1 * | 11/2013 | ..... E21B 10/32 |
| WO | 2014028457 | A1 | 2/2014 | |
| WO | 2014150524 | A2 | 9/2014 | |
| WO | 2014159079 | A1 | 10/2014 | |
| WO | 2015054227 | A2 | 4/2015 | |
| WO | WO-2015167786 | A1 * | 11/2015 | ..... E21B 10/322 |
| WO | WO-2015167788 | A1 * | 11/2015 | ..... E21B 10/43 |

OTHER PUBLICATIONS

Search Report under Section 17 of U.K. Patent Application No. 1412934.0, dated Jan. 16, 2015, 4 pages.
Exam Report under Section 18(3) of U.K. Patent Application No. 1412934.0, dated Sep. 2, 2016, 2 pages.
Search Report and Written Opinion of International Patent Application No. PCT/US2015/041224, dated Oct. 8, 2015, 11 pages.
Office Action issued in U.S. Appl. No. 15/328,051, dated Aug. 24, 2018, 22 pages.
Search Report and Written Opinion of International Patent Application No. PCT/US2015/041260, dated Oct. 19, 2015, 11 pages.
Search Report under Section 17(5) of U.K. Patent Application No. 1412933.2, dated Dec. 22, 2015, 4 pages.
Search Report under Section 17(5) of U.K. Patent Application No. 1412932.4, dated Jan. 16, 2015, 3 pages.
Exam Report under Section 18(3) of U.K. Patent Application No. 1412932.4, dated Jan. 23, 2018, 4 pages.
Exam Report under Section 18(3) of U.K. Patent Application No. 1412932.4, dated Nov. 18, 2016, 5 pages.
Search Report and Written Opinion of International Patent Application No. PCT/US2015/041265, dated Oct. 8, 2015, 12 pages.
Search Report under Section 17(5) of U.K. Patent Application No. 1412932.4, dated Jan. 12, 2015, 3 pages.
Search Report and Written Opinion of International Patent Application No. PCT/US2015/041223, dated Oct. 19, 2015, 11 pages.
Search Report under Section 17(5) of U.K. Patent Application No. 1412929.0, dated Jan. 12, 2015, 3 pages.
Combined Search and Exam Report under Sections 17 and 18(3) of U.K. Patent Application No. 1321625.4, dated Nov. 25, 2015, 8 pages.
Search Report and Written Opinion of International Patent Application No. PCT/US2015/041280, dated Oct. 13, 2015, 12 pages.
Combined Search and Exam Report under Sections 17 and 18(3) of U.K. Patent Application No. 1412930.8, dated Jan. 12, 2015, 5 pages.
Search Report and Written Opinion of International Patent Application No. PCT/US2015/040295, dated Oct. 12, 2015, 12 pages.
Combined Search and Exam Report under Sections 17 and 18(3) of U.K. Patent Application No. 1321625.4, dated May 7, 2014, 5 pages.
European Search Report of related EP Patent Application No. 14868423.6, dated Nov. 23, 2016, 3 pages.
European Exam Report of related EP Patent Application No. 14868423.6, dated Jan. 3, 2017, 5 pages.
Office Action issued in U.S. Appl. No. 15/102,039, dated Jun. 1, 2018, 15 pages.

* cited by examiner

REAMER

BACKGROUND

One practice which may be employed when drilling a borehole is to enlarge a hole with a reamer. A reamer may be constructed to have a fixed diameter, in which case the reamer must start cutting at the surface or at the end of an existing hole of equal or greater size. Alternatively a reamer can be constructed so as to be expandable so that it can enlarge a borehole to a greater diameter than that of the hole through which the (unexpanded) reamer was inserted.

Enlarging a borehole with a reamer may be done as a separate operation to enlarge an existing borehole drilled at an earlier time. Enlarging with a reamer may also be done at the same time as using a bottom hole assembly which has a drill bit at its bottom end. The drill bit makes an initial hole, sometimes referred to as pilot hole, and a reamer positioned at some distance above the drill bit increases the hole diameter.

There is more than one type of reaming tool. Some reamers are constructed to be eccentric, relative to the drill string to which they are attached and the borehole which they are enlarging. Other reamers are constructed to remain concentric with the drill string and the borehole. These different types of reamers tend to be used in different circumstances. There are many instances where concentric reamers are the appropriate choice.

A reamer may have a plurality of cutter assemblies, each comprising a support structure with attached cutters, arranged azimuthally around the axis of the tool. In the case of an expandable reaming tool it is common to have a plurality of radially expandable support elements bearing cutters positioned around the axis of the tool. Often the tool has three such cutter assemblies which extend axially and are arranged at 120° intervals azimuthally around the tool axis. A mechanism is provided for expanding these cutter assemblies radially outwardly from the axis and this mechanism typically uses hydraulic pressure to force the support structures of the cutter assemblies outwardly.

This tool construction has commonly been used for concentric reamers. In some constructions, each of the individual cutter assemblies arranged around the tool axis is an assembly of parts attached together so as to move bodily as one piece, in which case the assembly is often referred to as a "block" (one part of this assembly may be a shaped monolithic block) although the term "arm" has also been used for such an assembly. The individual cutter assemblies (i.e. individual blocks) may be moved outwards in unison by one drive mechanism acting on them all, or may be moved outwards by drive mechanism(s) which does not constrain them to move in unison.

Cutters attached to the supporting structure may be hard faced and may be PDC cutters having body with a polycrystalline diamond section at one end. The body may be moulded from hard material such as tungsten carbide particles infiltrated with metallic binder. The polycrystalline diamond section which provides the cutting part may then comprise particles of diamond and a binder. In many instances, the polycrystalline diamond section is a disc so that the hardest end of a cutter is a flat surface but other shapes can also be used.

Reamer designs customarily position at least some cutters with their cutting faces at the leading face of a support structure and with the cutters projecting radially outwardly from the support structure. The parts of the cutter which project outwardly beyond the support structure may be the parts of the cutter principally involved in cutting as the rotating reamer is advanced and/or as an expandable reamer is expanded.

The greatest radius described by a reamer (so-called full gauge) may be the radial distance from the axis to the extremity of the outermost cutter(s). In order to position a reamer centrally in the reamed bore, it is customary for a supporting structure to include a section which does not include cutters but has a so-called gauge pad (alternatively spelt "gage pad") which is a surface positioned to confront and slide on the wall of the reamed bore. In an expandable reamer, it is known to position gauge pads at a radius which is slightly less than full gauge so as to facilitate cutting during the period when the reamer is being expanded.

It is desirable that a reamer maintains stable cutting behaviour, centred on the axis of the existing bore, even though it has significant mass of collars and other drill string components placed above and/or below it. Yet frontal area in frictional contact with the formation, which helps to dampen oscillations, is smaller than with a drill bit of the same diameter. It has been observed that reamers tend to be more prone to the phenomenon of whirling than are drill bits. In this context, whirling refers to a motion in which the tool axis moves around a centre line rather than staying on it, leading to a mis-shaped or oversized borehole.

SUMMARY

This summary is provided to introduce a selection of concepts that are further described below. This summary is not intended to be used as an aid in limiting the scope of the subject matter claimed.

In one aspect, the subject matter disclosed here provides a reaming tool for enlarging an underground borehole, comprising a plurality of cutter assemblies distributed azimuthally around a longitudinal axis of the tool, wherein each cutter assembly comprises support structure bearing a sequence of cutters with leading surfaces facing in a direction of rotation of the tool and the sequence of cutters extends axially along the tool from an axial end of the tool with the cutters positioned at radial distances from the tool axis which progressively increase as the sequence extends away from the axial end of the tool. The radially outermost edges of the cutters and the supporting structure define a cutting outline which describes (i.e. traces out) a notional surface as the tool rotates. The support structure on each assembly may provide radially outward-facing surfaces aligned with the outer extremities of the cutters and extending circumferentially behind them.

At least one of the cutter assemblies includes guiding structure which is positioned circumferentially ahead of the leading faces of one or more cutters of the sequence on the assembly. This guiding structure is configured such that, as the tool rotates, the outline of the guiding structure is able to coincide with at least part of the notional surface described by the cutting outline of the preceding cutter assembly as the tool rotates, without any part of the guiding structure projecting outside that notional surface. The cutters following the guiding structure on the cutter assembly do project outwardly beyond the said notional surface described by the cutting outline of the preceding cutter assembly.

With this arrangement, the cutters on a cutter assembly project radially outwardly beyond the guiding structure which is ahead of the cutters on the same assembly, but the guiding structure projects radially no further than the cutting outline defined by the cutters and support structure of the assembly which precedes in the direction of rotation.

This arrangement may enhance stability during cutting by reducing opportunity for the tool to twist around the radial extremity of a cutter, which may for instance attempt to happen if the cutter snags on the formation which is being cut instead of cutting steadily through it.

As the tool rotates, every point on the tool may travel in a helical path as the tool both rotates and advances axially. It may be the case that if the tool is advancing at a predetermined rate, the outline of the guiding structure will coincide with the notional surface described by the cutting structure of the preceding assembly. If the axial advance is less, the outline of the guiding structure may travel close to, but slightly inwards from, the notional surface described by the preceding assembly. In this event the guiding structure may still make a significant contribution to stabilising the tool.

Possibly, all of the azimuthally distributed cutter assemblies include guiding structure which is positioned circumferentially ahead of the leading faces of one or more cutters of the sequence and which is configured such that the outline of the guiding structure is able to coincide with at least part of the notional surface described by the cutting outline of the preceding cutter assembly, without any part of the guiding structure projecting outside that notional surface.

One possibility is that a configuration of cutters in the sequence relative to each other, and in particular their axial and radial positions relative to each other, is the same on a plurality of cutter assemblies but positioned at differing distances from an axial end of the assemblies. The tool may have at least three cutter assemblies distributed azimuthally around the tool axis wherein:

a first assembly is followed by a second assembly and the second assembly is followed by a third assembly, a configuration of relative axial and radial positions of cutters of the sequence on a first cutter assembly is repeated on the second assembly at greater distance from the end of the assembly and greater radial distance from the tool axis and is repeated again on the third assembly at even greater distance from the end of the assembly and even greater radial distance from the tool axis, the second cutter assembly includes guiding structure which is positioned circumferentially ahead of the leading faces of one or more cutters of the sequence on the second assembly and is configured such that the outline of the guiding structure is able to coincide with at least part of the notional surface described by the cutting outline of the first cutter assembly, without any part of the guiding structure projecting outside that notional surface, while the cutters following the guiding structure on the second cutter assembly do project outwardly beyond the said notional surface described by the cutting outline of the first cutter assembly, and the third cutter assembly includes guiding structure which is positioned circumferentially ahead of the leading faces of one or more cutters of the sequence on the third assembly and is configured such that the outline of the guiding structure is able to coincide with at least part of the notional surface described by the cutting outline of the second cutter assembly, without any part of the guiding structure projecting outside that notional surface described by the cutting outline of the second cutter assembly, while the cutters following the guiding structure on the third cutter assembly do project outwardly beyond the notional surface described by the cutting outline of the second cutter assembly.

The first cutter assembly may similarly include guiding structure which is positioned circumferentially ahead of the leading faces of one or more cutters of the sequence on the first assembly. This guiding structure may be configured such that when the tool is advancing axially the outline of the guiding structure is able to coincide with at least part of the notional surface described by the cutting outline of the third cutter assembly, without any part of the guiding structure projecting outside the notional surface described by the cutting outline of the third cutter assembly, yet the cutters on the first cutter assembly following the guiding structure on the first assembly do project outwardly beyond the notional surface described by the cutting outline of the third cutter assembly.

The tool may have features to control the rate of axial advance. The surface of each cutter assembly may comprise zones facing in a direction towards the end of the tool, and the circumferential extent of these zones may be aligned with a helix around the tool axis rather than being orthogonal to the tool axis. Such a configuration may permit axial advance as the tool rotates yet also control the rate of advance.

Cutters used in accordance with the concepts disclosed above may have hard surfaces exposed as the leading faces of the cutters. These hard surfaces may be planar but other shapes, such as a domed or conical shape, are possible. Hard surfaced cutters may be polycrystalline diamond (PDC) cutters which have diamond crystals embedded in a binder material providing a hard face at one end of a cutter body. The radially outer extremity of a cutter may be located at a point at which the circular or other shape of the exposed leading face reaches its maximum distance from the tool axis. However, another possibility is that a cutter is shaped and positioned so that its outer extremity is not a point but is a linear edge parallel to the tool axis or an approximately planar face extending back from such an edge.

In further aspects, this disclosure includes methods of enlarging a borehole by rotating any reaming tool as defined above in the borehole and advancing the tool axially. The method may include expanding a reaming tool which has expandable cutter assemblies and then rotating the tool while also advancing the expanded tool axially.

DETAILED DESCRIPTION

Figure 1:
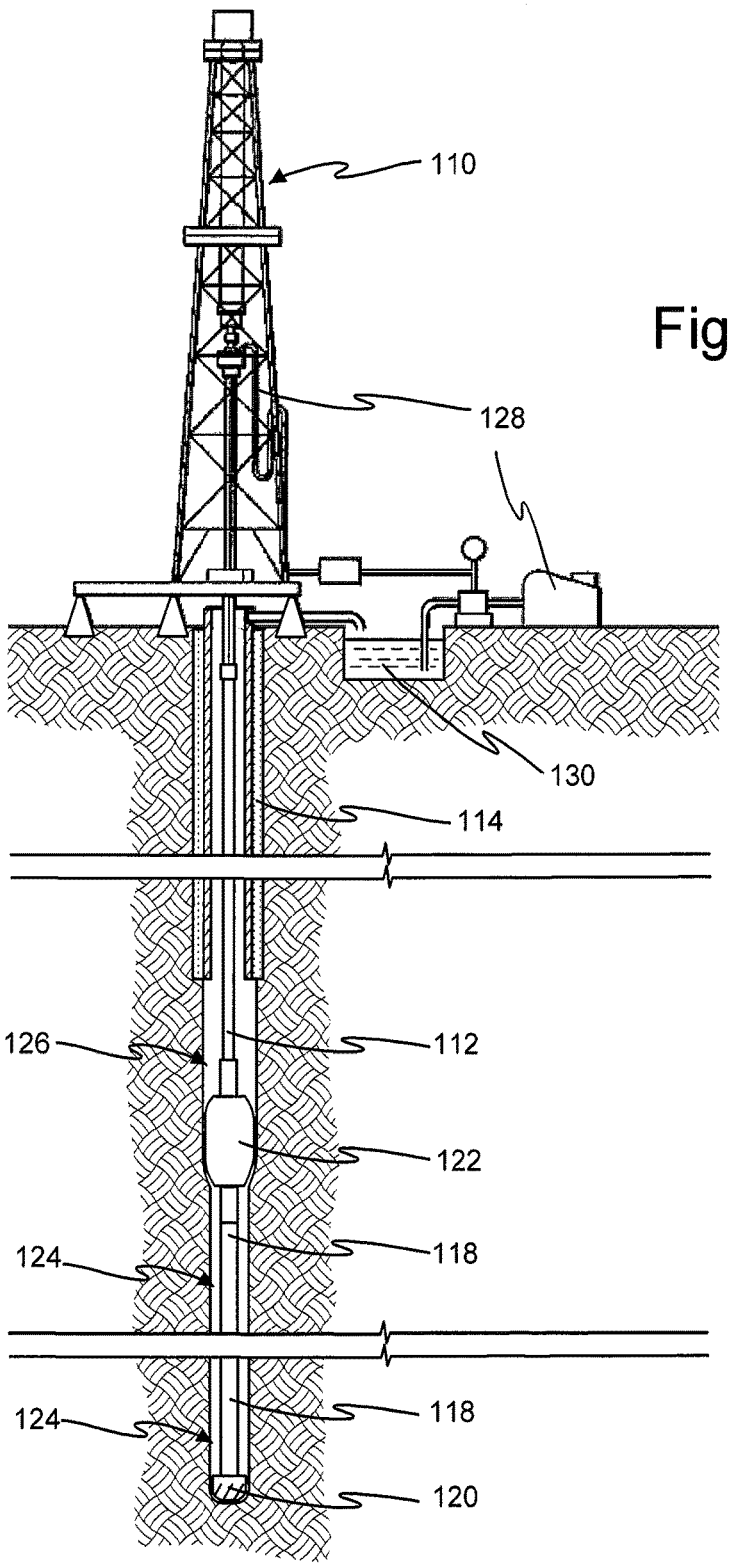
FIG. 1 is a schematic, cross-sectional view of a drilling assembly in a borehole.

FIG. 1 shows an exemplary drilling assembly which includes an expandable under-reamer 122. A drill string 112 extends from a drilling rig 110 into a borehole. An upper part of the borehole has already been lined with casing and cemented as indicated at 114. The drill string 112 is connected to a bottomhole assembly 118 which includes a drill bit 120 and an under-reamer 122 which has been expanded beneath the cased section 114. As the drill string 112 and bottomhole assembly 118 are rotated, the drill bit 120 extends a pilot hole 124 downwards while the reamer 122 simultaneously opens the pilot hole 124 to a larger diameter borehole 126.

The drilling rig is provided with a system 128 for pumping drilling fluid from a supply 130 down the drill string 112 to the reamer 122 and the drill bit 120. Some of this drilling fluid flows through passages in the reamer 122 and flows back up the annulus around the drill string 112 to the surface. The rest of the drilling fluid flows out through passages in the drill bit 120 and also flows back up the annulus around the drill string 112 to the surface. The distance between the reamer 122 and the drill bit 120 at the foot of the bottom hole assembly is fixed so that the pilot hole 124 and the enlarged borehole 126 are extended downwardly simultaneously.

Figure 5:
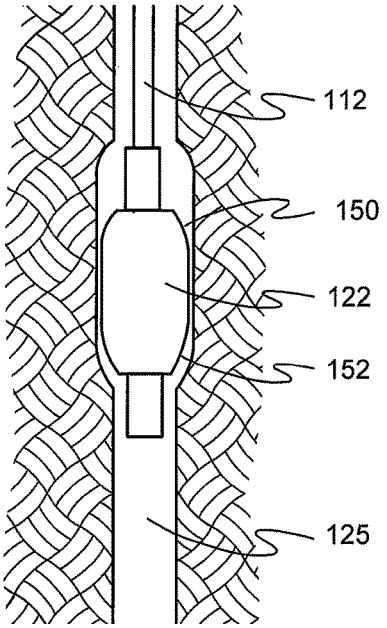
FIG. 5 is a schematic, cross-sectional view of the reamer expanded in a pre-existing borehole.

As shown in FIG. 5, it would similarly be possible to use the same reamer 122 attached to drill string 112, although without the drill bit 120 and the part of the bottom hole assembly 118 shown below the reamer 122 in FIG. 1, to enlarge a borehole 125 which had been drilled previously. In FIG. 5, the initial expansion of the reamer has created a fairly short section where the borehole has enlarged diameter. This enlarged portion of the borehole can then be elongated downwardly by advancing the drill string 112 and reamer 122 downwardly.

Figure 2:
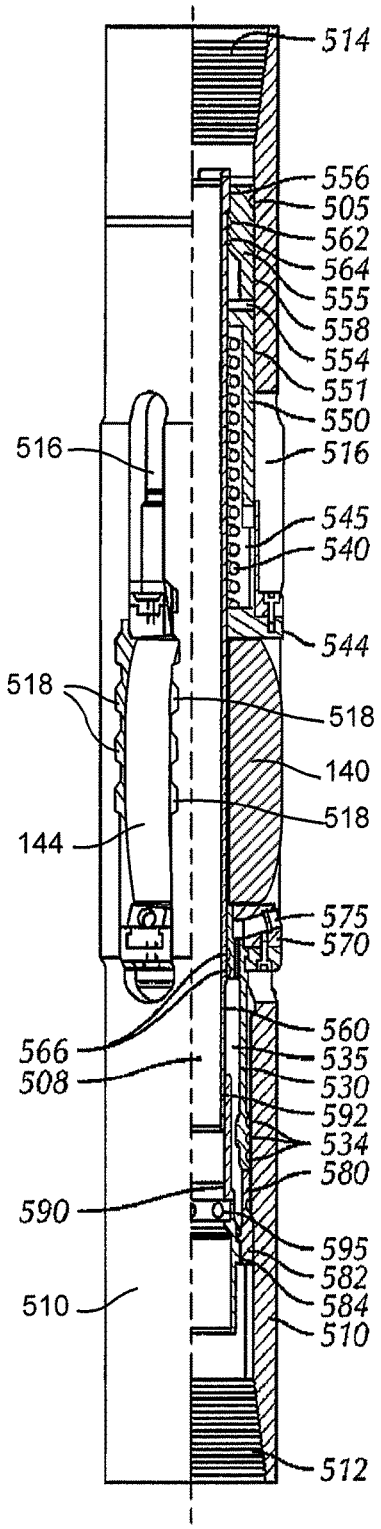
FIG. 2 is a cross-sectional elevation view of one embodiment of expandable reamer, showing its expandable cutter blocks in collapsed position.
Figure 3:
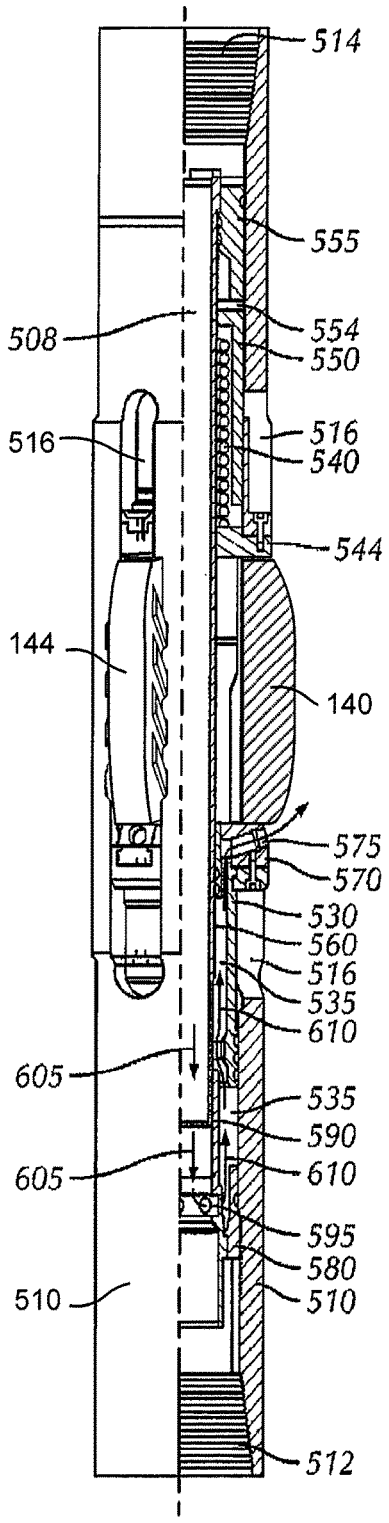
FIG. 3 is a cross-sectional elevation view of the expandable reamer of FIG. 2, showing the blocks in expanded position.

Referring now to FIGS. 2 and 3, one embodiment of expandable reaming tool is shown in a collapsed position in FIG. 2 and in an expanded position in FIG. 3. The expandable tool comprises a generally cylindrical tool body 510 with a central flowbore 508 for drilling fluid. The tool body 510 includes upper 514 and lower 512 connection portions for connecting the tool into a drilling assembly. Intermediately between these connection portions 512, 514 there are three recesses 516 formed in the body 510 and spaced apart at 120° intervals azimuthally around the axis of the tool.

Each recess 516 accommodates a cutter assembly 140 in its collapsed position. This cutter assembly has the general form of a block, and comprises support structure to which cutters are attached. One such cutting block 140 is shown in perspective in FIG. 4. The block 140 has an outer face 144 which confronts the wall of the borehole and side faces with protruding ribs 142 which extend at an angle to the tool axis. These ribs 142 engage in channels 518 at the sides of a recess 516 and thus provide a guide mechanism such that when the block 140 is pushed upwardly relative to the tool body 510, it also moves radially outwardly to the position shown in FIG. 3 in which the blocks 140 extend radially outwardly from the tool body 510. The blocks move in unison and so are all at the same axial positions relative to the tool body. Details of the outer face 144 of a block 140 have been omitted from FIGS. 2 and 3.

A spring 540 biases the block 140 downwards to the collapsed position of FIG. 2. The biasing spring 540 is disposed within a spring cavity 545 and covered by a spring retainer 550 which is locked in position by an upper cap 555. A stop ring 544 is provided at the lower end of spring 540 to keep the spring in position.

Below the moveable blocks 140, a drive ring 570 is provided that includes one or more nozzles 575. An actuating piston 530 that forms a piston cavity 535 is attached to the drive ring 570. The piston 530 is able to move axially within the tool. An inner mandrel 560 is the innermost component within the tool 500, and it slidingly engages a lower retainer 590 at 592. The lower retainer 590 includes ports 595 that allow drilling fluid to flow from the flowbore 508 into the piston chamber 535 to actuate the piston 530.

The piston 530 sealingly engages the inner mandrel 560 at 566, and sealingly engages the body 510 at 534. A lower cap 580 provides a stop for the downward axial movement of piston 530. This cap 580 is threadedly connected to the body 510 and to the lower retainer 590 at 582, 584, respectively. Sealing engagement is provided at 586 between the lower cap 580 and the body 510.

A threaded connection is provided at 556 between the upper cap 555 and the inner mandrel 560 and at 558 between the upper cap 555 and body 510. The upper cap 555 sealingly engages the body 510 at 505, and sealingly engages the inner mandrel 560 at 562 and 564.

In operation, drilling fluid flows along path 605, through ports 595 in the lower retainer 590 and along path 610 into the piston chamber 535. The differential pressure between the fluid in the flowbore 508 and the fluid in the borehole annulus surrounding tool 500 causes the piston 530 to move axially upwardly from the position shown in FIG. 2 to the position shown in FIG. 3. A small amount of flow can pass through the piston chamber 535 and through nozzles 575 to the annulus as the tool 500 starts to expand. As the piston 530 moves axially upwardly, it urges the drive ring 570 axially upwardly against the blocks 140. The drive ring pushes on all the blocks 140 simultaneously and moves them all axially upwardly in recesses 516 and also radially outwardly as the ribs 142 slide in the channels 518. The blocks 140 are thus driven upwardly and outwardly in unison towards the expanded position shown in FIG. 3.

The movement of the blocks 140 is eventually limited by contact with the spring retainer 550. When the spring 540 is fully compressed against the retainer 550, it acts as a stop and the blocks can travel no further. There is provision for adjustment of the maximum travel of the blocks 140. The spring retainer 550 connects to the body 510 via a screwthread at 551. A wrench slot 554 is provided between the upper cap 555 and the spring retainer 550, which provides room for a wrench to be inserted to adjust the position of the screwthreaded spring retainer 550 in the body 510. This allows the maximum expanded diameter of the reamer to be set at the surface. The upper cap 555 is also a screwthreaded component and it is used to lock the spring retainer 550 once it has been positioned.

Figure 4:
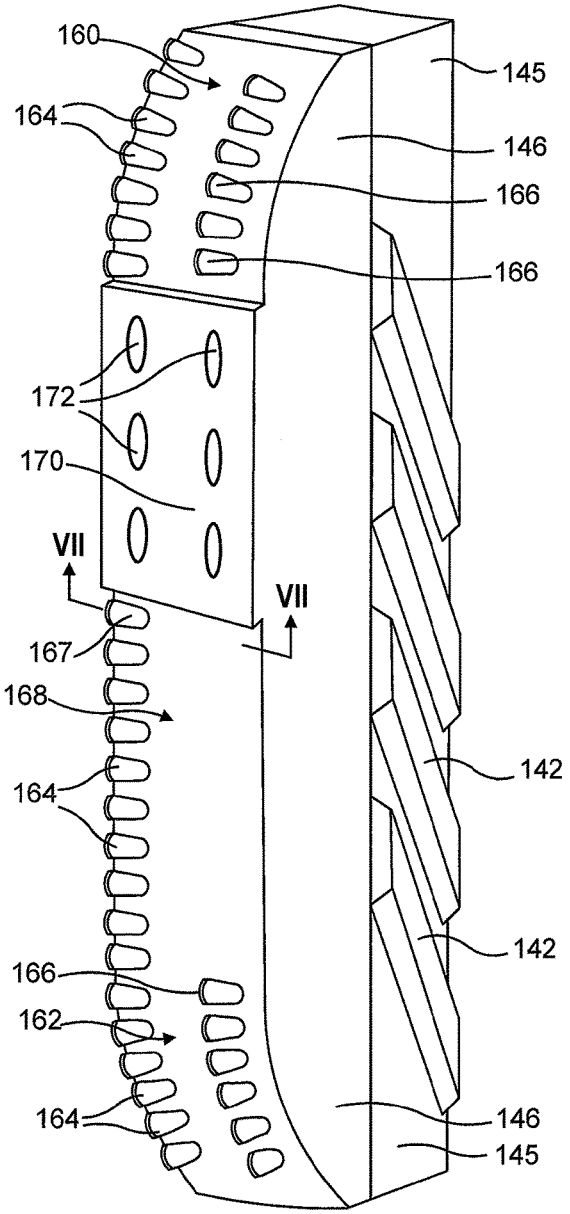
FIG. 4 is a perspective view of a cutter block for the expandable reamer of FIGS. 2 and 3.

FIG. 4 is a perspective view of a cutter block 140 showing the outer face of the block and the side face which is the trailing face in the direction of rotation. There is a conventional arrangement of cutters on the outer face. The block is formed of an inner part 145 and an outer part 146 bolted to the part 145 by bolts (not shown). The inner part 145 is steel and incorporates the protruding ribs 142. The outer part 146 of the block 140 is also steel and has polycrystalline diamond (PDC) cutters secured to it.

Figure 6:
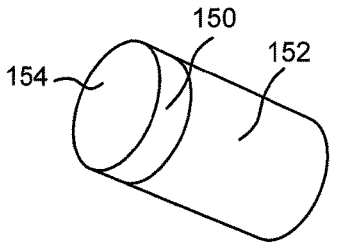
FIG. 6 is a detail view of a PDC cutter.

As shown in FIG. 6 such cutters have a sintered disc 150 of diamond crystals embedded in a binder material. This disc is at one end of a cylindrical body 152 which may be a sintered mass of tungsten carbide particles and a binder material. The bodies 152 of cutters are secured, for example by brazing, to the outer part 146 of the block 140 so that the hard faces 154 of the cutters (printed by the sintered diamond crystals) are exposed. Although the cutter shown in FIG. 6 has a hard surface 154 which is a flat face, other shapes including cones can be used for the hard surface.

The outer part 146 of the block 140 has upper and lower cutting portions 160, 162 on which PDC cutters are arranged in a leading row of cutters 164 and a following row of cutters 166. It will be appreciated that the upper and lower cutting portions 160, 162 are inclined (they are curved as shown) so that the cutters in these regions extend outwards from the tool axis by amounts which are least at the top and bottom ends of the block 140 and greatest adjacent the middle section 168 which includes stabilising pad 170.

When a reamer is advanced downwardly within a hole to enlarge the hole, it is the curved lower cutting portions 162 which do the work of cutting through formation rock. This takes place in FIGS. 1 and 5 as the drill string is advanced. The enlarged portion of the borehole can also be extended upwardly using the cutting portions 160 on the blocks 140 to remove formation rock while pulling upwardly on the drill string 112.

The stabilising pad 170 does not include cutters but has a generally smooth, part-cylindrical outward surface positioned to face and slide over the borehole wall. To increase resistance to wear, the stabilising pad 170 may have pieces 172 of harder material embedded in it and lying flush with the outward facing surface.

Figure 7:
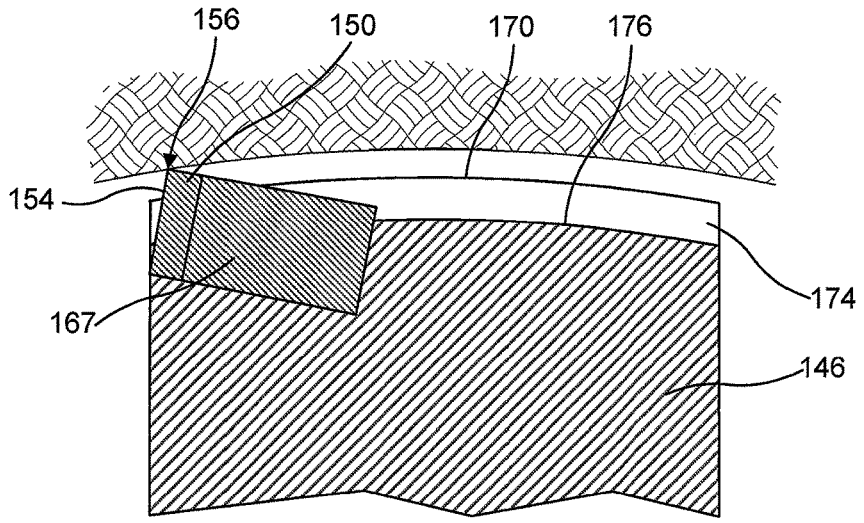
FIG. 7 is a cross section on the line VII-VII of FIG. 4.

FIG. 7 is a section on line VII-VII of FIG. 4 showing one PDC cutter 167 mounted to the outer part 146 of the block 142. The cutter 167 is partially embedded in the outer part 146 and is oriented so that the hard face 154 will be facing forwards when the reamer is rotated. This hard face extends outwards to an extremity 156 which is at the maximum radius of the rotating reamer (i.e. its full gauge). The extremities of the other PDC cutters secured to the middle region 168 are also at the maximum radius of by the rotating reamer. The outer surface of the stabilising pad 170 is positioned slightly radially inward from the extremities 156 of the cutters. The axially facing surface of the stabilising pad is indicated in FIG. 7 at 174 and the outer surface of the support structure in which the cutters are embedded is indicated at 176. This arrangement in which cutter extremities are at full gauge and pads 170 are slightly under gauge is conventionally used with an aim that stabilising pads 170 do not impede expansion of the reamer.

Without limitation as to theory, the inventors believe that the extremity 156 of a cutter can become a pivot point, for instance if the extremity 156 snags briefly on the rock wall of the borehole as the reamer is rotated, rather than cutting steadily through the rock. The reamer may attempt to turn bodily around this pivot point. The inventors believe this may cause vibration and/or initiate whirling motion even though other cutter blocks of the reamer may oppose or limit such pivoting.

Figure 8:
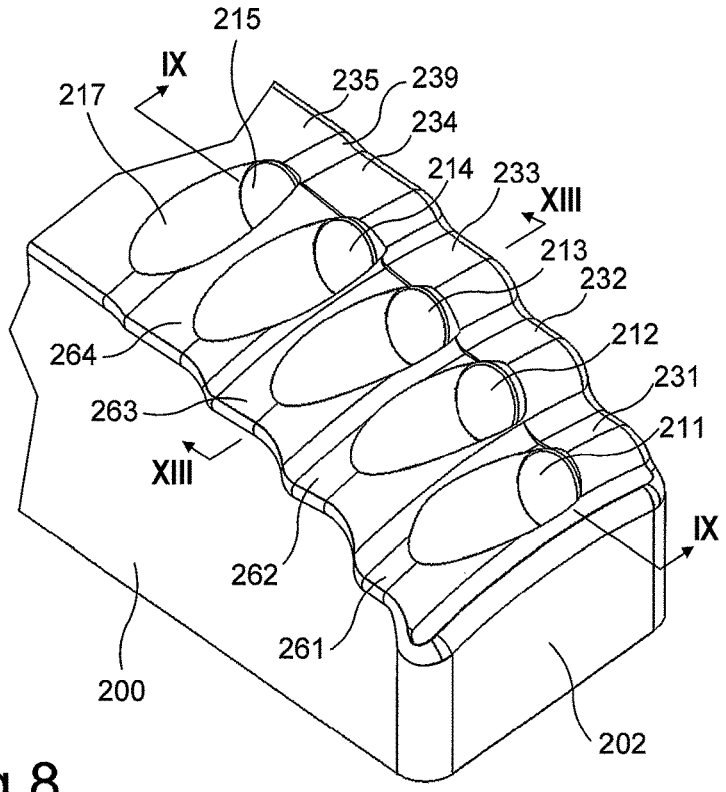
FIG. 8 is an isometric drawing of the lower cutting portion of the outer part of a cutter block.

The reamer as described above, referring to FIGS. 1 to 7, is of a conventional construction. FIG. 8 onwards show parts of an expandable reamer which utilises much of this conventional construction but has a cutter arrangement and cutter blocks in accordance with the novel concepts disclosed here. Specifically, the reamer of FIG. 8 onwards utilises the expandable construction shown in FIGS. 2 and 3 and has cutter blocks with inner and outer parts as in FIG. 4. However, the construction of the outer parts of the cutter blocks and the arrangement of the cutters on the blocks is different from that shown in FIG. 4 and is in accordance with novel aspects of the present disclosure.

Figure 13:
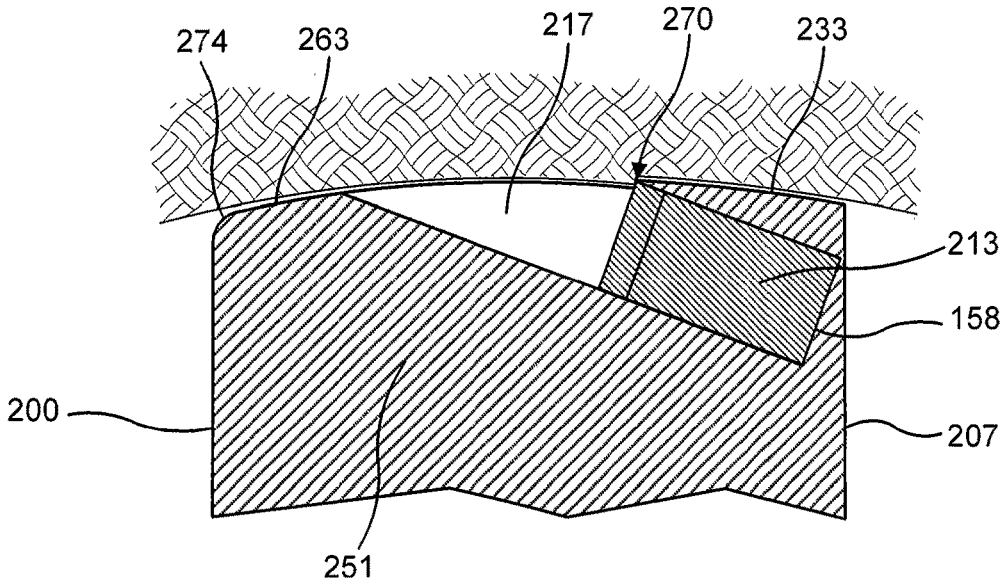
FIG. 13 is a cross section on the line XIII-XIII of FIGS. 8 to 10.

As with the conventional construction, the outer part of each cutter block is a steel support structure for PDC cutters. FIG. 8 provides a general isometric view of the lower cutting portion of the outer part of a cutter block. The block has a side face 200 which is the leading face in the direction of rotation and it has a lower axial end 202. The trailing face of the block is indicated 207 in FIG. 13.

A sequence of PDC cutters 211-215 is positioned with the hard surfaces of the cutters exposed and facing forward in the direction of rotation. Each cutter is secured by brazing within a cavity in the support structure, so that its leading face is set back from the leading face 200 of the block and, as shown by the section which is FIG. 13, the trailing end 158 of the body of the cutter is adjacent to the trailing face 207 of the block. Each tubular cavity in the support structure which receives a cutter is prolonged forwardly and outwardly to allow insertion of the cutter. This is visible as a curved recess 217 in the outer face of the cutter block extending forwardly from each cutter.

The cutters 211-215 are positioned at progressively increasing radial distances from the tool axis and the outermost extremity of cutter 215 is at the maximum radius, i.e. full gauge, of the reamer.

The outer face of the support structure includes surfaces 231-234 which extend back (i.e. in the direction opposite to rotation) from the leading faces of the utters 211-214. Each of these surfaces 231-234 is a portion of a cylinder with a radius which lies on the tool axis when the cutter blocks are fully expanded. As seen in the section which is FIG. 13, these surfaces are aligned radially with the extremities of the respective cutters 211-214. A surface 235 at full gauge includes an area which extends back from the cutter 215. The outer face of the block also includes connecting portions 238 between the surfaces 231-234. These portions include curvature so as to extend radially relative to the tool axis. The surfaces 234 and 235 are connected through a portion 239 which is slightly inclined relative to the tool axis.

The radially outer parts of cutters 211-214 and the support structure (including surfaces 231-234) surrounding the cutters define a cutting outline which sweeps out a notional surface as the tool rotates. For the block seen in FIG. 8, the cutting outline is the upper edge of the cross-section shown as FIG. 9. As the tool rotates, the part cylindrical surfaces 231-234 follow the cutters 211-214 along the notional surface described (i.e. swept out) by the cutting outline and in doing so they slide against freshly cut rock. More specifically, the surface 231 slides over rock which has just been cut by the action of cutter 211, surface 232 slides over rock cut by cutter 212 and so on. Of course, the rock surfaces created by cutters 211-214 have only a transient existence because they are cut into by cutters at a greater radius as the reamer advances. Nevertheless, this provision of surfaces 231-234 close to the formation rock contributes to stabilisation of the position of the rotating reamer, as will be mentioned below with reference to FIG. 13.

Figure 9:
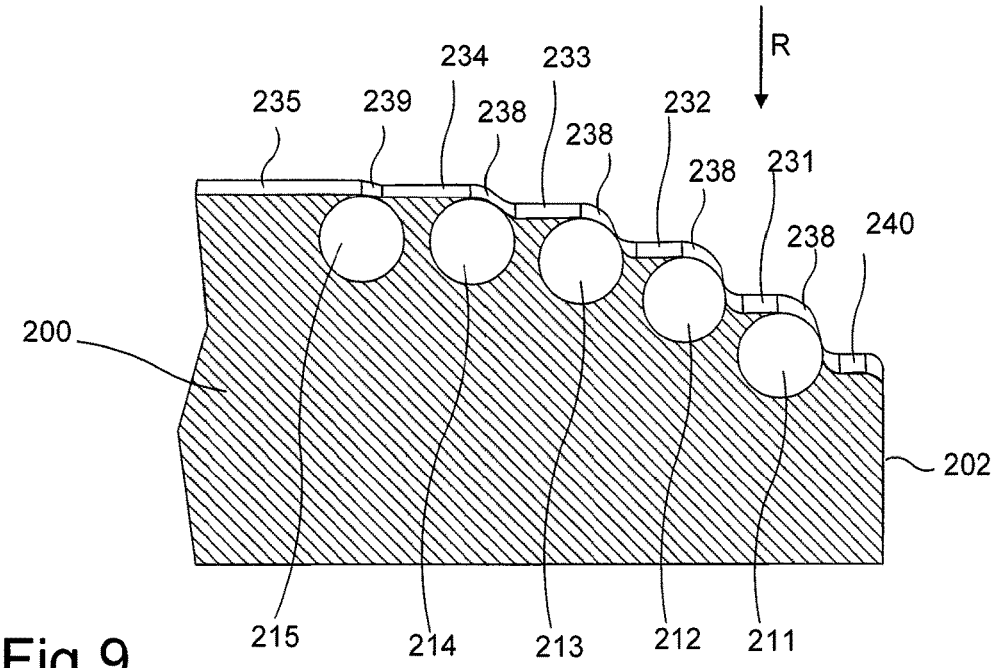
FIG. 9 is a cross section on the line IX-IX of FIG. 8.
Figure 10:
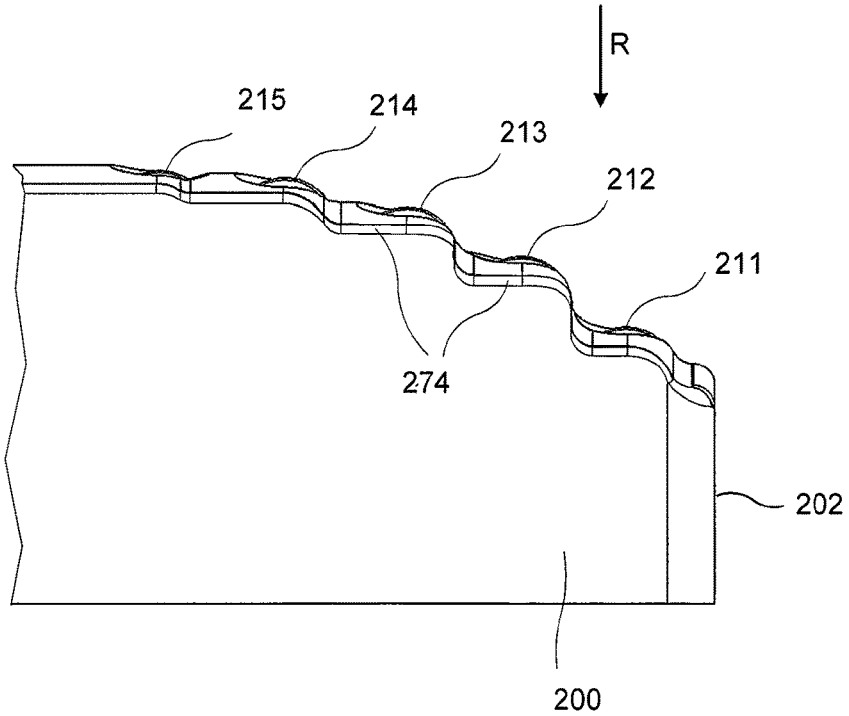
FIG. 10 is a side view of the lower cutting portion shown in FIG. 8.
Figure 11:
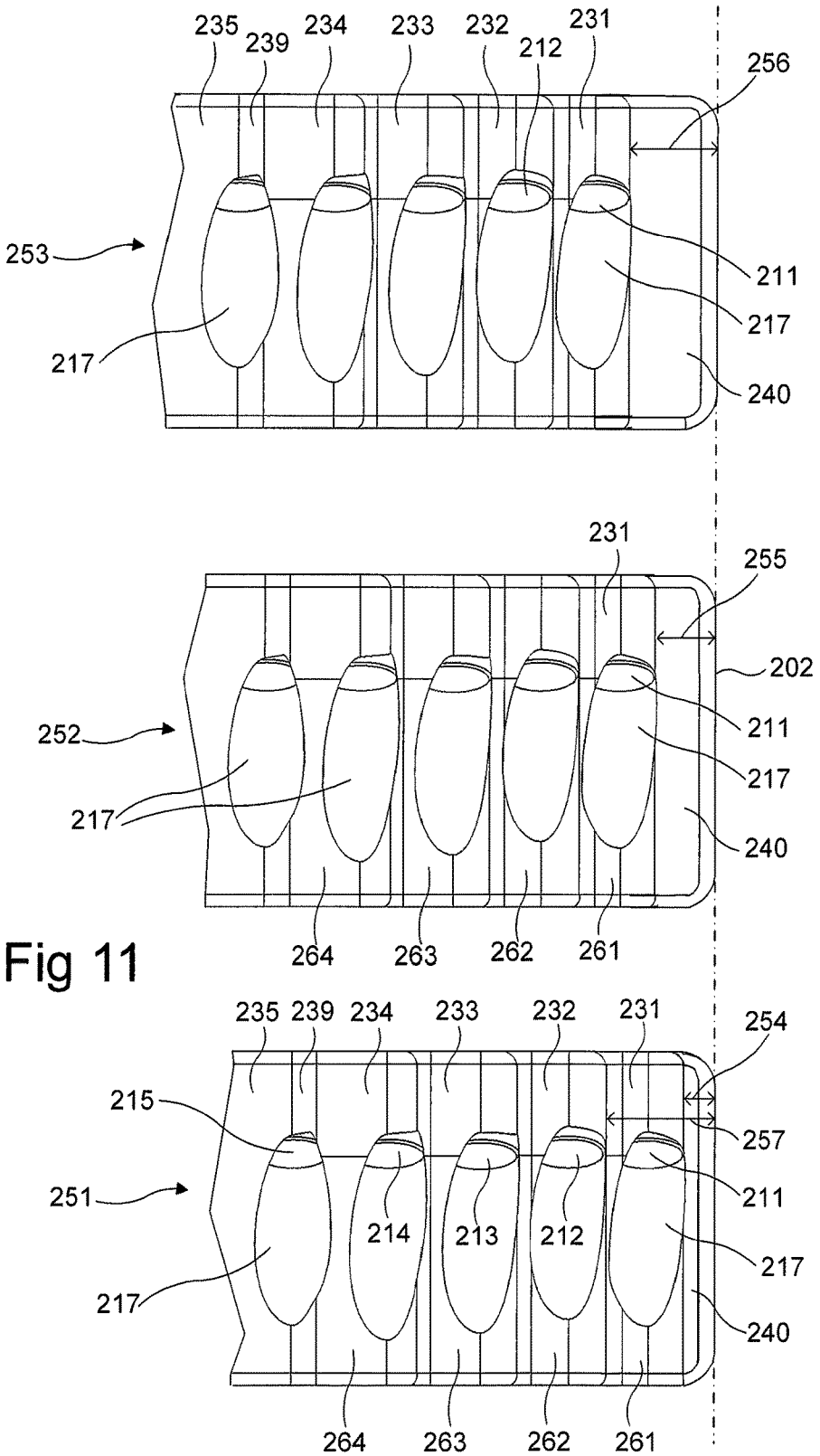
FIG. 11 is a view onto the lower cutting portions of three cutter blocks.

FIG. 11 shows the lower cutting portions of the three cutter blocks of the reamer. The ends 202 of the blocks are aligned axially as indicated by a chain-dotted line. The block shown in FIGS. 8 to 10 is block 251 at the bottom of the diagram. The lower cutting portions of the other two blocks are indicated at 252 and 253. These follow block 251 as the reamer is rotated and of course block 251 follows block 253.

The configuration of cutters 211-214 and the supporting structure around them, as described above with reference to FIGS. 8 to 10 for block 251, is reproduced on blocks 252 and 253. Thus the axial and radial positions of cutters 211-214 relative to each other is the same on all three cutter blocks, but the axial distances between these functional parts and the ends of the blocks and the radial distances from these functional parts to the tool axis differs from one block to another.

More specifically, as indicated by the arrows 254, 255, 256 the axial distances from the end of each block to the edge of cutter 211, and likewise the distances to the other cutters, increase in the order: block 251, block 252, block 253. However, the distance indicated by arrow 256 to the edge of cutter 211 of block 253 is not as great as the distance 257 to the edge of cutter 212 of block 251. The cutters 211-214 of the block 252 are positioned radially slightly further from the axis of the tool than the corresponding cutters of block 251. Similarly the cutters 211-214 of block 253 are positioned slightly further from the axis of the tool than the corresponding cutters 211-214 of block 252. Axial distances from the ends of the blocks to the cutters 215 also increase in the order block 251, block 252, block 253, but the cutters 215 are at full gauge and so at the same radial distance from the tool axis.

The axial positions of the cutters on the blocks are arranged so that corresponding points in the cutting outlines of these lower portions of the three blocks lie on a helix around the tool axis. For example the radially outer extremities of the cutters 211 of the three blocks lie on a helix around axis. Moreover, in this embodiment the axial and radial distances and the spacing between cutters of the sequence on each block is such that the outer extremities of all the cutters 212-214 also lie on a continuation of the same helix, as is illustrated diagrammatically by FIG. 12.

Figure 12:
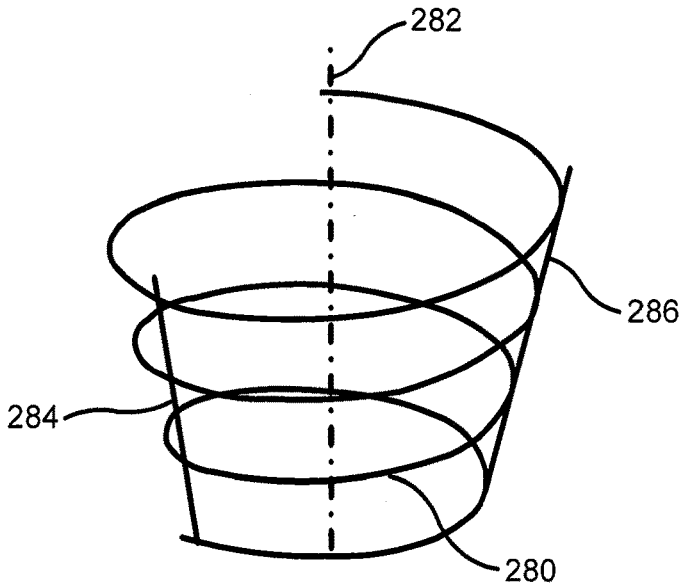
FIG. 12 diagrammatically illustrates positioning on a helix.

FIG. 12 shows the path of a helix as a solid line 280. This helix has progressively increasing diameter as it winds upwards around axis 282. The block 251 is positioned so that (when expanded) the radial extremities of its cutters 211-214 lie on the helix 280 at its intersections with vertical line 284. The block 252 is positioned so that the radial extremities of its cutters 211-214 are on the helix 280 at its intersections with vertical line 286, which is 120° around the axis from line 284. The block 253 is positioned so that the radial extremities of its cutters 211-214 also lie on the helix 280 at its intersections with a further vertical line (not shown) which is 120° around the axis from line 286 and so would be at the back of the helix as depicted in FIG. 12.

With the arrangement shown by FIGS. 11 and 12, if the tool advances axially during one revolution by an amount equal to the spacing between successive turns of the helix, the cutters on each block will travel along a path already cut by cutters on the preceding block. More specifically, rock is first cut by cutter 211 of block 251 because this is closest to the lower end of the tool and closest to the tool axis. This is then followed by cutter 211 of block 252, then by cutter 211 of block 253 and then by cutter 212 of block 251, cutter 212 of block 252 and so on.

This arrangement on a helix of increasing diameter enables all cutters 211-214 of the lower cutting portions of the blocks to cut into the rock as the tool rotates. The cutters 211-214 of the block 252 are positioned slightly further from the axis of the tool than the corresponding cutters of block 251. Similarly the cutters 211-214 of block 253 are positioned slightly further from the axis of the tool than the corresponding cutters 211-214 of block 252. In consequence of this arrangement, the lower cutting portions of all three cutter blocks cut into the rock as the tool rotates.

On each cutter block the part of the support structure which is ahead of the hard faces of the cutters (i.e. forwardly from them in the direction of rotation), provides a guiding structure which is shaped and dimensioned to have an outline which is a replica of the cutting outline of the preceding block. So, for example, block 252 has part cylindrical guiding surfaces 261-264 which are at the same radial distances from the tool axis as surfaces 231-234 of the preceding block 251. As the tool rotates, these surfaces 261-264 on block 252 slide across rock surface exposed by the cutters 211-214 of block 251 before the cutters on block 252 make a further cut into the rock.

There is a small step 267 between the surfaces 261-264 on block 252 and the surfaces 231-234 on the same block 252 because the latter are at slightly greater radius from the tool axis. There is a similar step 267 on block 253 and also on block 251.

Provision of the guiding surfaces 261-264 on each block, configured to slide on rock surfaces exposed by the cutting outline of the preceding block, serves to stabilise the position of the block and hence the position of the reader as it is rotating. This is illustrated by the section on line XIII-XIII shown in FIG. 13. As the tool rotates the radially outer extremity 270 of the cutter 213 may snag on the rock so that the block 251 (and indeed the whole tool) attempts to pivot around this extremity in the clockwise direction indicated as 271 in FIG. 13. Any such pivoting around the extremity 218 in the clockwise direction 271 is limited by the surface 263 abutting the borehole wall. Pivoting in the opposite (anti-clockwise) direction is less likely but is limited by the surface 233 abutting the borehole wall. The surface 263, and likewise the leading surfaces 261, 262 and 264 meet the face 200 of the block at leading edges formed as smooth curves 274 so as to inhibit these leading edges from snagging on the borehole wall during rotation.

Figure 14:
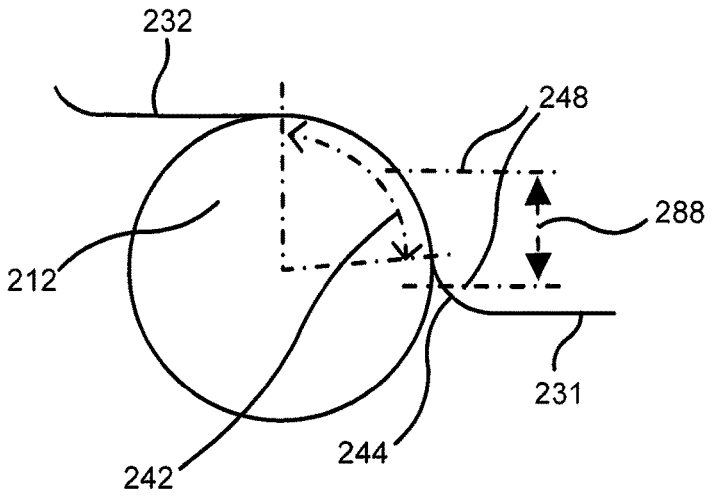
FIG. 14 is a diagrammatic enlarged view showing one cutter of the block of FIG. 9.

As mentioned briefly above, the outer face of the block includes portions 238 connecting the part cylindrical surfaces 231-234. This is illustrated in more detail by FIG. 14 which shows the connection between surfaces 232 and 231. From the surface 232 towards surface 231 the outer face of the support structure curves through an arc (indicated by angle 242) where it is aligned with the perimeter of cutter 232. It then curves in the opposite sense, as seen at 244, to join the part cylindrical surface 231. There is a similar arrangement between surfaces 234 and 233, between 233 and 232 and also between surface 231 and a part cylindrical surface 240 located between cutter 211 and the axial end 202 of the block. These connecting portions of the outer face of the block have zones, such as between the chain lines 248, which face in a generally axial direction and so face towards formation rock which is to be cut away as the reamer advances axially. Facing in a generally axial direction may mean that a line normal (i.e. perpendicular) to the surface is at an angle of no more than 45° to the tool axis.

Figure 15:
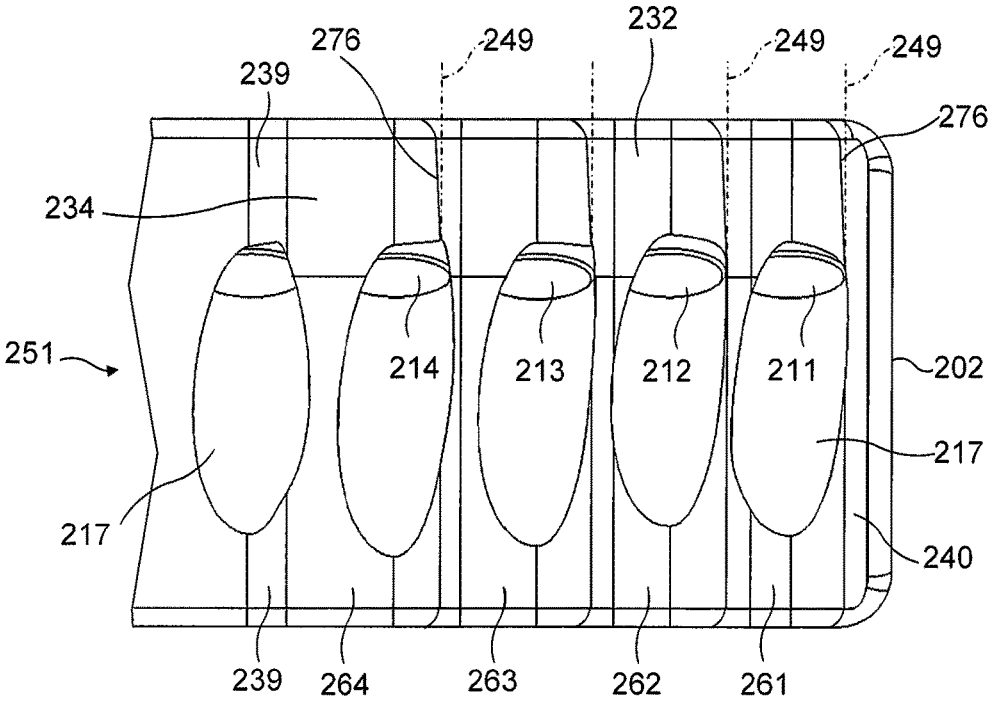
FIG. 15 is an enlarged radial view onto the lower cutting portion of a cutter block in the direction of arrow R in FIGS. 9 and 10.

If the circumferential direction of these zones extends orthogonally to the tool axis, there is a possibility that contact between these zones and the rock may impede or block axial advance. To avoid this, these zones may be slanted away from the orthogonal so as to extend away from the end of the tool. This is illustrated by FIG. 15 which is an enlarged view, looking radially inwards as indicated by arrow R in FIG. 9, onto the cutter block 251. Directions orthogonal to the axis of the reamer are shown by chain dotted lines 249. The lines 276 aligned with edges of cutters 211-213 in FIG. 15 are the inflection where curvature through arc 242 changes to curvature through arc 244. The zones of outer surface which face generally axially are shaped to taper away from the end of the reamer as they extend circumferentially back from the exposed surfaces of the cutters 211-214. Thus the lines 276 are at an angle to the orthogonal direction which is indicated by the chain dotted lines 249. The consequence of this configuration is that the shape of the outer surface of the cutter block does not prevent axial advance but the angle between the lines 276 and the orthogonal lines may impose a limitation on the rate of advance. The inventors have found that this is not a problem: the angle may be chosen to be the same as the angle of the notional helix 280 (so that the axially facing zones lie on a helix similar to 280) and this may give a controlled rate of advance which is as good, or better than, a rate of advance achieved with a conventional tool which has less stability.

The above description and FIGS. 8 to 14 refer to the lower cutting portions of cutter assemblies. The primary function of these lower cutter portions is to enlarge a hole as the reamer advances axially. The central portions of the cutter blocks above these lower cutting portions may have a row of cutters at full gauge, primarily to cut rock while the reamer is being expanded. The arrangement of cutters and gauge pads in these central portions may be a conventional arrangement as shown in FIG. 4, or may be some other arrangement.

It will be appreciated that the example embodiments described in detail above can be modified and varied within the scope of the concepts which they exemplify. Features referred to above or shown in individual embodiments above may be used together in any combination as well as those which have been shown and described specifically. The arrangements of stabilising pads and cutters could also be used in a reamer which does not expand and instead has cutter blocks at a fixed distance from the reamer axis. Other mechanisms for expanding a reamer are known and may be used. Cutters may be embedded or partially embedded in supporting structure. They may be secured by brazing or in other ways. The hard faces of the cutters will of course need to be exposed so that they can cut rock, but the radially inner part of a cylindrical cutters' hard face may possibly be covered or hidden by a part of the support structure so that the hard face is only partially exposed. Accordingly, all such modifications are intended to be included within the scope of this disclosure as defined in the following claims.

The invention claimed is:

1. A reaming tool for enlarging an underground borehole, comprising:

a plurality of cutter assemblies distributed azimuthally around a longitudinal axis of the tool;

wherein each cutter assembly includes a supporting structure bearing a sequence of cutters with leading surfaces facing in a direction of rotation of the tool, the sequence of cutters extends axially along the tool from an axial end of the tool with the cutters positioned at radial distances from the tool axis which progressively increase as the sequence extends away from the axial end of the tool, the radially outer edges of the cutters and the supporting structure defining a cutting outline; and wherein at least one trailing cutter assembly includes guiding structure which is positioned on an outer surface of the at least one trailing cutter assembly and which is circumferentially ahead of the leading faces of one or more cutters of the sequence of the at least one trailing cutter assembly, and which is configured such that an outline of the guiding structure on the at least one trailing cutter assembly is shaped and dimensioned to be a replica of at least part of an axially aligned portion of the cutting outline of the cutter assembly that rotationally precedes the at least one trailing cutter assembly, such that the guiding structure on the at least one trailing cutter assembly does not project radially beyond the at least part of the axially aligned portion of the cutting outline of the at least one preceding cutter assembly, while the cutters following the guiding structure on the at least one trailing cutter assembly project radially beyond the at least part of the axially aligned portion of the cutting outline of the preceding cutter assembly.

2. The reaming tool of claim 1 wherein the guiding structure is a first guiding structure of a plurality of guiding structures, and wherein each one of the plurality of cutter assemblies distributed azimuthally around a longitudinal axis of the tool includes a respective guiding structure of the plurality of guiding structures which is positioned circumferentially ahead of the leading faces of one or more cutters of the sequence and which is configured such that the outline of the respective guiding structure is able to coincide with at least part of the axially aligned portion of cutting outline of the preceding cutter assembly, without any part of the guiding structure projecting radially beyond the at least part of the axially aligned portion of cutting outline of the preceding cutter assembly, while the cutters following the guiding structure on the cutter assembly project radially beyond the at least part of the axially aligned portion of cutting outline of the preceding cutter assembly.

3. The reaming tool of claim 1 wherein a configuration of relative radial and axial positions of cutters in the sequence is the same on a plurality of cutter assemblies but positioned at differing distances from an axial end of the assemblies.

4. The reaming tool of claim 1, the plurality of cutter assemblies comprising at least three cutter assemblies wherein:

a first cutter assembly is followed by a second cutter assembly and the second cutter assembly is followed by a third cutter assembly;

a configuration of relative radial and axial positions of cutters of the sequence on the first cutter assembly is repeated on the second cutter assembly at greater distance from the end of the assembly and greater radial distance from the tool axis and is repeated again on the third cutter assembly at even greater distance from the end of the assembly and even greater radial distance from the tool axis;

the second cutter assembly includes guiding structure which is positioned circumferentially ahead of the leading faces of one or more cutters of the sequence on the second cutter assembly and is configured such that the outline of the guiding structure on the second cutter assembly is shaped and dimensioned to be a replica of at least part of an axially aligned portion of the cutting outline of the first cutter assembly, without any part of the guiding structure on the second cutter assembly projecting radially beyond the at least part of the axially aligned portion of the cutting outline of the first cutter assembly, while the cutters following the guiding structure on the second cutter assembly project radially beyond the at least part of the axially aligned portion of the cutting outline of the first cutter assembly; and the third cutter assembly includes guiding structure which is positioned circumferentially ahead of the leading faces of one or more cutters of the sequence on the third cutter assembly and is configured such that the outline of the guiding structure on the third cutter assembly is shaped and dimensioned to be a replica of at least part of an axially aligned portion of the cutting outline of the second cutter assembly, without any part of the guiding structure on the third cutter assembly projecting radially beyond the at least part of the axially aligned portion of the cutting outline of the second cutter assembly, while the cutters following the guiding structure on the third cutter assembly project radially beyond the at least part of the axially aligned portion of the second cutter assembly.

5. The reaming tool of claim 4 wherein the first cutter assembly includes guiding structure which is positioned circumferentially ahead of the leading faces of one or more cutters of the sequence on the first assembly and is configured such that when the tool is advancing axially the outline of the guiding structure on the first cutter assembly is shaped and dimensioned to be a replica of at least part of an axially aligned portion of the cutting outline of the third cutter assembly, without any part of the guiding structure on the first cutter assembly projecting outside the at least part of the axially aligned portion of the cutting outline of the third cutter assembly, while the cutters following the guiding structure on the first cutter assembly project radially beyond the at least part of the axially aligned portion of the cutting outline of the third cutter assembly.

6. The reaming tool of claim 4 wherein the configuration of cutters on the first cutter assembly and which is repeated on the second and third cutter assemblies is positioned such that corresponding points in each configuration of cutters lie on a helix around the axis of the tool.

7. A tool according to claim 1 wherein the outer surface of each cutter assembly comprises zones facing in a direction towards the end of the tool, and these zones are aligned with a helix around the tool axis.

8. The reaming tool of claim 7 wherein each zone is an area of the outer surface of the cutter assembly within which all lines perpendicular to the zone surface are between 0° and 45° to the tool axis.

9. The reaming tool of claim 1 wherein the supporting structure comprises a radially outward-facing surface behind the leading face of at least one cutter and aligned with a radially outward extremity of the at least one cutter so that the at least one cutter does not project outwardly beyond the outward-facing surface behind the at least one cutter.

10. The reaming tool of claim 9 wherein the radially outward-facing surface is a part cylindrical surface following the at least one cutter.

11. The reaming tool of claim 1 wherein the sequence of cutters are the only cutters on a portion of the cutter assembly extending from the axial end of the tool.

12. The reaming tool of claim 1 wherein the cutter assemblies are expandable radially from the tool axis.

13. The reaming tool of claim 1 wherein at least a portion of the outline of the guiding structure on the at least one trailing cutter assembly is part cylindrical and matches a part cylindrical outline of an axially aligned cutter of the sequence of cutters of the preceding cutter assembly.

14. The reaming tool of claim 1 wherein the guiding structure on the at least one trailing cutter assembly includes at least one step between two or more guide surfaces of the guiding structure on the at least one trailing cutter assembly.

15. A method of enlarging a borehole by rotating a reaming tool as defined in claim 1 in the borehole and advancing the tool axially.

* * * * *